US008733019B2

(12) United States Patent
Vulpitta

(10) Patent No.: US 8,733,019 B2
(45) Date of Patent: May 27, 2014

(54) UNDER DOOR DRAFT BLOCKER

(75) Inventor: Brian A Vulpitta, Avon Lake, OH (US)

(73) Assignee: Shurtech Brands, LLC, Avon, OH (US)

( * ) Notice: Subject to any disclaimer, the term of this patent is extended or adjusted under 35 U.S.C. 154(b) by 0 days.

(21) Appl. No.: 13/544,239

(22) Filed: Jul. 9, 2012

(65) Prior Publication Data

US 2012/0272581 A1 Nov. 1, 2012

Related U.S. Application Data

(63) Continuation of application No. 13/343,876, filed on Jan. 5, 2012, now abandoned, which is a continuation of application No. 12/538,217, filed on Aug. 10, 2009, now abandoned.

(51) Int. Cl.
*E06B 7/00* (2006.01)

(52) U.S. Cl.
USPC ..... 49/70

(58) Field of Classification Search
USPC ..... 49/70, 469, 470, 467, 475.1, 482.1; 292/342, 343; 16/82; 160/40
See application file for complete search history.

(56) References Cited

U.S. PATENT DOCUMENTS

| | | | | |
|---|---|---|---|---|
| 712,240 | A | 10/1902 | Barnes et al. | |
| 1,336,527 | A | 4/1920 | Lewis | |
| 1,625,764 | A | 4/1927 | Bosley | |
| 1,883,609 | A | 10/1932 | Dennis | |
| 2,347,158 | A | 4/1944 | Spraragen | |
| 2,560,308 | A | 7/1951 | Spraragen | |
| 4,034,511 | A | 7/1977 | Bursk | |
| 4,483,101 | A | 11/1984 | Berzina | |
| 4,639,027 | A | 1/1987 | Boyd | |
| 4,691,478 | A | 9/1987 | Lorg | |
| 4,765,094 | A | 8/1988 | Gemmell | |
| 5,475,946 | A | 12/1995 | Howe | |
| 5,475,948 | A | 12/1995 | Parke | |
| D371,600 | S | 7/1996 | Henry | |
| 5,794,871 | A | 8/1998 | Willetts | |
| 6,374,545 | B1 | 4/2002 | Baczuk | |
| 6,560,932 | B2 | 5/2003 | Heroux | |
| 7,401,439 | B2 | 7/2008 | Heroux | |
| 7,891,136 | B1 | 2/2011 | Heroux | |
| 8,141,298 | B2 * | 3/2012 | Heroux | 49/470 |
| 2011/0120023 | A1 | 5/2011 | Heroux | |

FOREIGN PATENT DOCUMENTS

| | | | |
|---|---|---|---|
| FR | 2 675 532 | A1 | 10/1992 |
| FR | 2 787 825 | A3 | 6/2000 |
| GB | 875480 | | 8/1961 |
| GB | 1079667 | | 8/1967 |
| GB | 2109447 | | 6/1983 |
| GB | 2170541 | A | 8/1986 |
| GB | 2 238 069 | A | 5/1991 |
| GB | 2255121 | | 10/1992 |
| GB | 2 294 282 | A | 4/1996 |

* cited by examiner

*Primary Examiner* — Jerry Redman
(74) *Attorney, Agent, or Firm* — Fay Sharpe, LLP

(57) ABSTRACT

A draft blocker using flexible linear elements contained in an envelope is easily installed upon a door or window. The draft blocker comprises linear elements contained in cavities adapted to ride against the inside and outside of the door thereby sealing the gap between a door and preventing drafts. The draft blocker uses one or more envelope elements allowing insertion of the linear elements at a position other than the ends and has end straps which engage the edges of the door bottom holding the draft blocker in place.

19 Claims, 8 Drawing Sheets

UNDER DOOR DRAFT BLOCKER

CROSS-REFERENCE TO RELATED APPLICATIONS

This application is a continuation of U.S. application Ser. No. 13/343,876, filed Jan. 5, 2012, now abandoned, which is a continuation of U.S. application Ser. No. 12/538,217, filed Aug. 10, 2009, now abandoned, the entire contents of each of which are herein incorporated by reference.

BACKGROUND OF THE INVENTION

1. Field of the Invention

The present application relates to a draft blocker and more particularly to a draft blocker which engages the bottom of a window or door and prevents drafts from entering beneath the door in a doorway or window.

2. Background of the Disclosure

Homes are generally provided with several doors and windows allowing occupants to enter and leave the home and also to allow sunshine and air into the home at appropriate times. However, in very cold weather and very hot weather, it is desirable to limit or eliminate the flow of air into and out of a home through windows and doors. Flow of air through and around windows and doors during particularly cold weather is often perceived as drafts. Such drafts sometimes cause discomfort. This may lead to an occupant raising the set point of a thermostat and can add to the costs of heating a home. Similarly, in very warm weather, air entering in and around doors and windows creates warm air drafts increasing cooling costs and decreasing comfort.

The elimination or minimization of unwanted air flow or drafts is addressed in many ways. Modern windows, doors and door frames significantly reduce drafts when compared to older designs. However, even with modern windows and doors, drafts are sometimes created after windows and doors age or for other reasons. Home occupants can address some drafts through and around windows with caulks, weather stripping and the like. Numerous products addressing these needs are available commercially.

Doors present special issues in excluding drafts. Doors are normally hinged in door frames. A door has an outer surface, an inner surface, two side edges, a top edge and a bottom edge. The two side edges and the top edge face generally flat surfaces in the door frame. Moreover, the outward facing side or the inward facing side of the door often abuts a narrow surface in the door frame. Weather stripping of various sorts can be applied to the door frame on these narrow surfaces facing the door or on the door frame surfaces facing the door edges. The bottom edge of the door presents difficulties in weather stripping as the bottom edge of the door faces the threshold or door sill. The door sill or threshold is frequently trod upon.

Doors are normally capable of being opened. There is frequently a gap between the bottom of the door and the door sill. Without a gap, if the fit is too tight, the door may stick. Moreover, the bottom of the door must be sufficiently high so that the door may pass over adjacent rugs, mats, flooring and the like. Door frames sometimes deviate from square either when it is installed or as the framing in a house ages. For these and other reasons, the bottoms of doors are frequently worn upwardly or sometimes cut upwardly to accommodate misalignment or floor coverings.

The door sill or threshold is subject to abuse when heavy items are moved into or out of a home. The door sill or threshold is frequently subject accumulations of dirt, accumulations of water, and other abuse. Weather stripping is therefore frequently not a reasonable option for excluding and otherwise sealing the gap between the bottom of the door and the door frame.

Not all home occupants are home owners. Many people rent. People who are not home owners may not be authorized to permanently affix structures to doors or door thresholds. Home owners and non-owning occupants may sometimes wish to apply temporary draft prevention structures to a door. One improvised draft prevention structure is a bunched towel at the base of a closed door. With this approach, one must reposition the towel every time the door is opened and reclosed.

SUMMARY OF THE DISCLOSURE

In accordance with the present disclosure, a draft blocker adapted for use on a door or window is provided having an envelope with two linear cavities, each cavity having two closed ends, and a web interconnecting the linear cavities in spaced parallel relationship. The linear cavities are provided with openings allowing insertion of flexible linear elements. The draft blocker is used by installing it adjacent the bottom of the door with the web under the bottom door edge and the linear elements in the linear cavities engaging the inner and outer surfaces of the door itself The draft blocker thus moves with the door when the door is opened or closed and prevents drafts through the gap between the door bottom and door sill.

Further in accordance with the disclosure, the envelope of the draft blocker is constructed of flexible sheet material with the closed ends of the linear cavities connected to one another by flexible straps.

Still further in accordance with the disclosure, at least a portion of the draft blocker envelope is elastic (stretchy) whereby the door blocker may be stretched in the process of application to a door bottom and thereafter snuggly engage the door bottom holding the draft blocker tightly in place.

Yet further in accordance with the invention, the envelope is sufficiently elastic to allow the draft blocker to snuggly fit doors of various widths by adjusting (cutting) the linear elements only.

Further in accordance with the disclosure, the draft blocker envelope is provided with at least one closure element selectively closing the opening to the linear cavity.

Still further in accordance with the invention, the closure element is a flap.

Yet further in accordance with the disclosure, the draft blocker envelope is constructed of a fabric sheet material joined by sewing and at least a portion of the fabric sheet material is a coated fabric sheet material.

Still further in accordance with the invention, the coated fabric sheet material comprises raised coated islands on said fabric sheet material.

Further in accordance with the disclosure, the linear elements contained in the linear cavities are cylindrical, flexible, foam elements.

In accordance with a alternate draft blocker of the disclosure, at least two flexible linear elements are provided as well as at least two envelope elements. A first envelope element has two linear cavities and a web interconnecting the two linear cavities. Each of the linear cavities has a closed end and an open end. Each of the linear cavities is adapted to accept one of the linear elements. A second envelope element also has two linear cavities and a web interconnecting the two linear cavities. Each of the linear cavities has an open end and the second envelope element is adapted to telescope over the first envelope element with the open ends of the respective linear cavities passing around/into each other. The second ends of the linear cavities in the second envelope element may be open or closed. If closed, the two envelope elements create an adjustable length pair of linear cavities accommodating the flexible linear elements and forming a complete door bottom draft blocker. If the second envelope element has open linear cavity second ends, then a third envelope element similar in construction to the first envelope element is provided to telescope into the second end of the second envelope element. In this manner, an adjustable length pair of linear cavities is created accommodating the linear flexible element and forming a complete under door draft blocker. Fasteners hold the envelope elements together.

It is the principle object of the present disclosure to provide an under door draft blocker which is easily installed, easily removed, and which will not damage the door to which it is applied.

It is yet another object of the present disclosure to provide a draft blocker which is adjustable in length to accommodate different size doors.

It is yet another object of the present disclosure to provide a draft blocker which can be sold as a single product but which is adjustable to fit doors of different widths.

It is another object of the present disclosure to provide a draft blocker which is durable, attractive, easily cleaned by a consumer, easily removed, and easily reinstalled.

It is still another object of the present disclosure to provide a draft blocker which fits snuggly against the bottom of the door, moves easily with the door when one is opening and closing the door, and will not interfere with the door's ability to easily open and close.

These and other objects of the disclosure will become apparent in the following description of the exemplary embodiments taken together with the accompanying drawings.

BRIEF DESCRIPTION OF THE DRAWINGS

The disclosure may take physical form in certain parts and arrangements of parts, examples of which will be described in detail and which are illustrated in the accompanying drawings which form a part hereof and wherein.

DETAILED DESCRIPTION

Figure 1A:
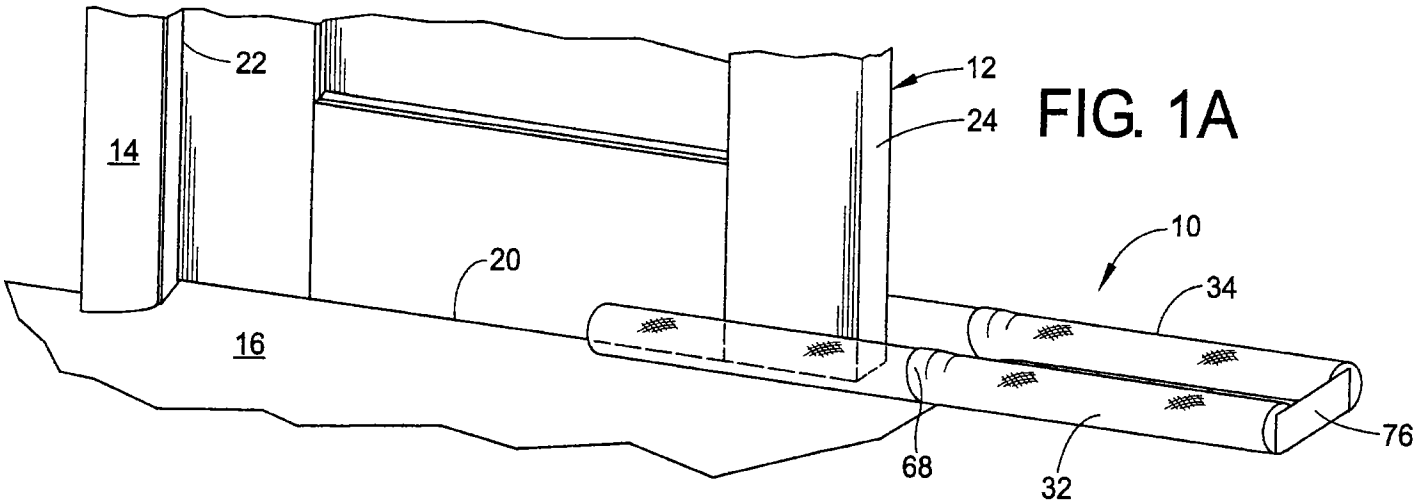
FIG. 1A is a perspective view of an embodiment of the disclosure being installed upon a door
Figure 1B:
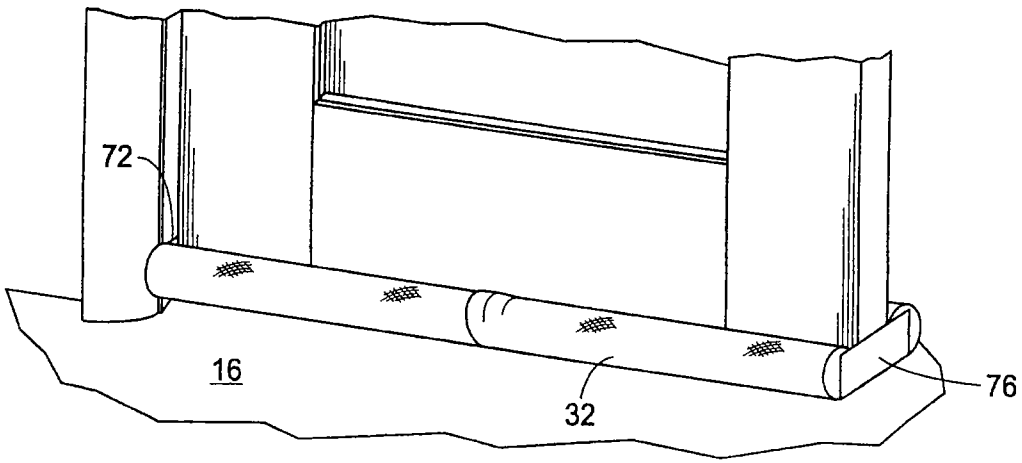
FIG. 1B is a perspective view of the embodiment of FIG. 1A fully installed upon a door.

With reference to FIG. 1A, a draft blocker 10 for use under a door 12 is illustrated. The door 12 is mounted on a door frame 14 as is conventional. The door frame 14 is conventional and comprises two generally vertical frame size (only one of which is shown) and a frame top (not shown). The door frame resembles an inverted U. Such door frames enclose interior doors and doors to the exterior in homes, businesses and the like. The door frame often sits on top of a door sill or threshold. Sometimes, particularly with interior doors, there is no separate door sill or threshold. Rather, the door frame sits over a continuation of a floor from one enclosed space or room into a second enclosed space or room. Conventionally, a door 12 is supported within the door frame 14 by means of hinges along one side of the door 12 which also engaged the door frame 14. The door 12 is often equipped with a doorknob engaging a latching mechanism and sometimes equipped with a lock. The door 12 moves between an open position allowing people to move through the door frame; and, a closed position in which the door frame 14 is substantially fully occupied by the door 12 and access through the door frame 14 is not possible. Conventionally, the door frame 14 often includes a surface extending inwardly against which the door 12 abuts when in a closed position. This surface impedes the flow of air between the door and door frame along both sides and across its top. Moreover, weather stripping of one type or another is often provided either on the edges of the door or on surfaces of the door frame further reducing the air flow between the door and the door frame when the door 12 is closed against the door frame 14.

The bottom of the door 12 slides along the floor 16 when the door is opened or closed. In many homes and businesses, the floor 16 may be covered with carpet, rugs, or other floor covering. In some doorways, there is a raised threshold at the base of the door frame 14 on the floor 16. In other doorways, there is no raised threshold. Rather, the floor continues from one room into another room as a flat surface with no raised portion. In such situations, carpeting may be on one or both sides of the doors or other floor covering may be on one or both sides of the door.

The door 12 has a bottom 20. The door 12 also has a hinge edge 22 and a free edge 24. The thickness of the door 12 may vary over its extent but is generally uniform around its edges. The thickness of doors in general is not fixed. Frequently, the thickness of doors around their edges is from one to two inches. Doors thinner than one inch are sometimes encountered. Doors thicker than two inches are sometimes encountered.

The width of doors, that is the length of the door bottom and the door top, also varies. Doors may be 20 inches wide or less. Doors may be 36 inches wide. Some door frames are wider than 36 inches and accommodate two doors, one on each side of the frame, with the doors closing or opening independently of one another. Doors from the interior of a house to the exterior vary in width. Doors connecting apartments and condominiums to common space hallways also vary in the width. However, home entryway doors are frequently in the range of widths from 30-40 inches.

The bottoms of doors are generally flat but are not always parallel to the floor above which they move. Some doors, particularly entryway doors between the outside and the interior of a home slant with a bigger gap between the door bottom and the floor on one side then the other. The slant sometimes is provided to facilitate engagement of a door bottom to a door seal on a threshold. Door bottoms and the floors for thresholds under door bottoms are subject to wear and sometimes become different shape than the flat surface originally intended. Door bottoms are gouged, trimmed and otherwise changed over their lifetime.

Figure 2:
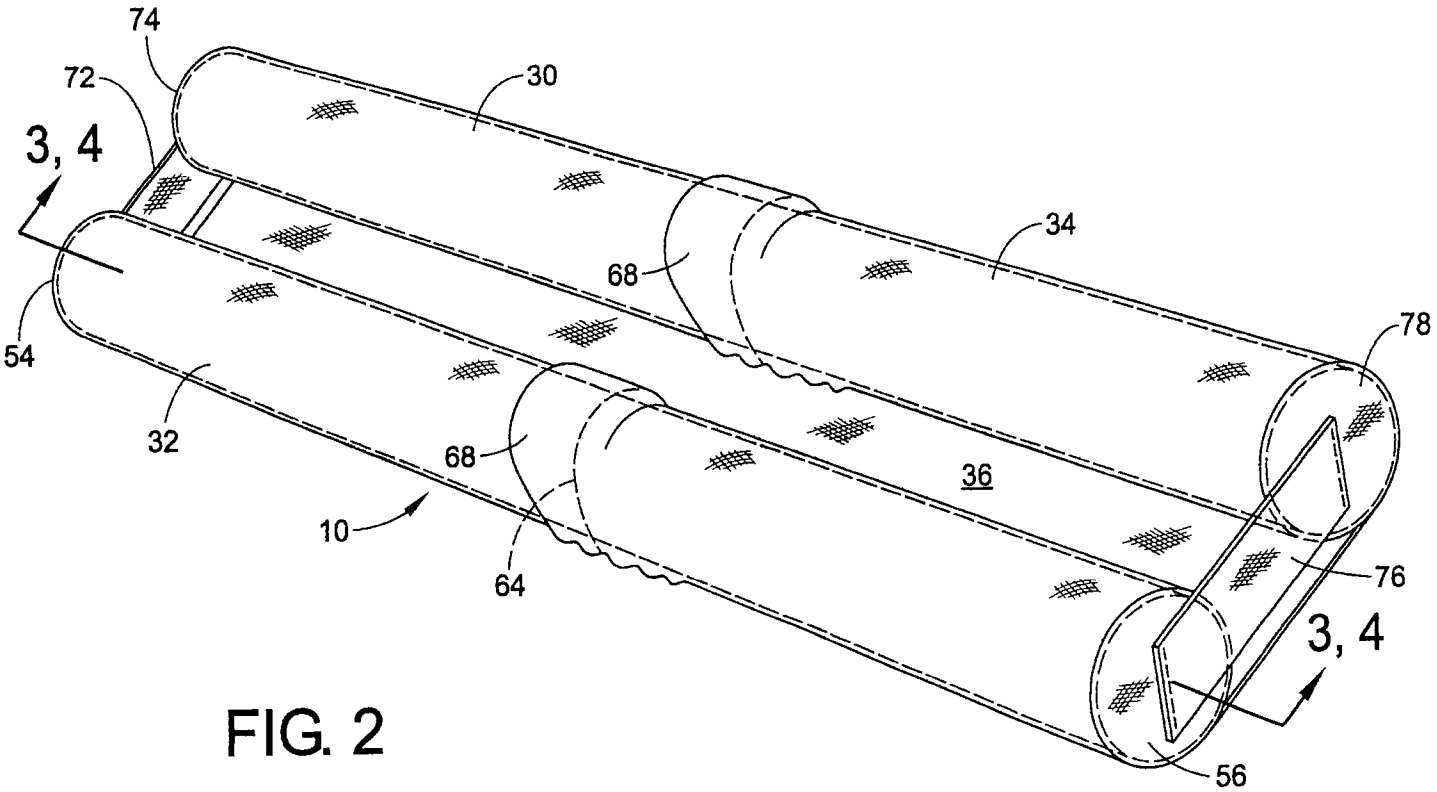
FIG. 2 is a perspective view of the embodiment of FIGS. 1A and 1B not installed upon a door.
Figure 3:
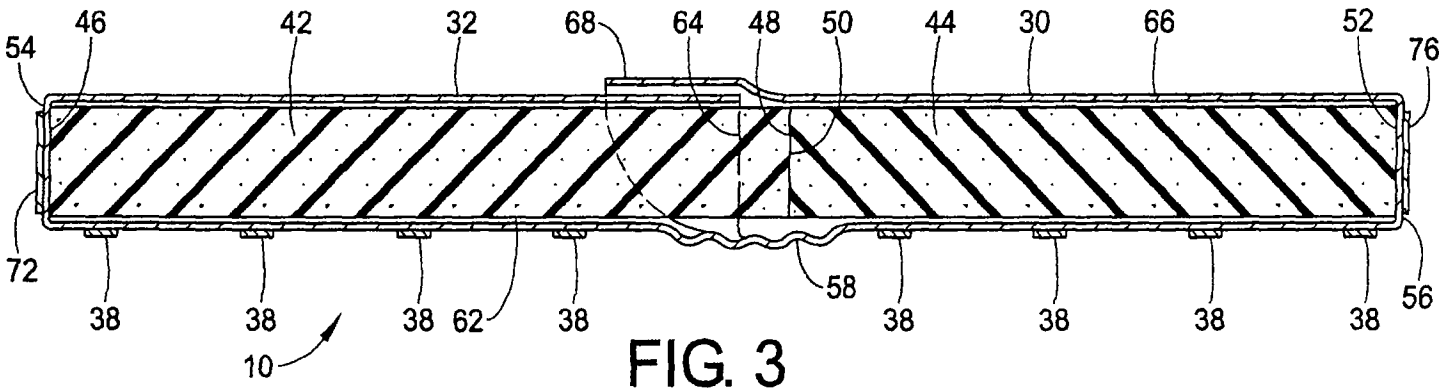
FIG. 3 is a cross section taken along line 3-3 of FIG. 2.

With reference to FIGS. 2 and 3, a draft blocker 10 in accordance with the present disclosure is illustrated. An envelope 30 is constructed from sheet material. The envelope 30 can be a traditional fabric woven from natural or synthetic materials. Preferably, the envelope 30 is at least partially woven from elastic fibers providing some stretch to the envelope 30. Alternatively, the envelope can be fabricated from other sheet material such as plastic film material. Again, preferably, such material is preferred to have some elasticity providing stretch to the envelope 30. Still further alternatively, the envelope 30 can be constructed from a combination of materials including fabric and other sheet materials or fabrics or other woven materials coated on one or both sides over its entire surface or over only a portion of its extent. As seen in FIG. 2, the envelope 30 has a first linear cavity 32 and a second linear cavity 34. The two linear cavities, 32, 34 are substantially identical to one another, having the same cross-sectional area and the same length. This is not necessary to the embodiment. One of the linear cavities can be longer than the other linear cavity. One of the linear cavities can have a larger cross section than the other linear cavity. The first linear cavity 32 and the second linear cavity 34 of the embodiment both have circular cross sections. However, this is not necessary. Other cross sections can be used.

The first linear cavity 32 and the second linear cavity 34 are interconnected by a web 36. The web 36 is a flat, flexible, generally rectangular piece of material interconnecting the two linear cavities 32, 34 in a spaced parallel relationship. In the preferred embodiment, the web 36 is two layers of material, a top layer and a bottom layer. In the preferred embodiment, the two linear cavities 32, 34 have circular cross sections with a diameter slightly larger than 1⅜ inches. The web 36 interconnecting the two linear cavities 32, 34 is about one inch in width and has a length equal to the length of the two linear cavities 32, 34.

Sewing is not the only method available joining material to form the envelope 30. Some fabrics and sheet materials can be joined through heat welding or adhesives or other means. Any such means is useful in forming the present draft blocker 10 so long as it is used in a way allowing one to define and create the elements described herein.

With reference now to FIG. 3, a first flexible linear element 42 and a second flexible linear element 44 are shown contained in the first linear cavity 32. The first flexible linear element 42 is a compressible, flexible, foam plastic cylinder. The cylinder has two flat parallel ends and a single cylindrical side wall. The first flexible linear element 42 can be closed or opened cell plastic foam of any suitable material. In the preferred embodiment of the first flexible linear element 42 is about 13/8 inches. However, different diameters can be used while still provide the utility of the present embodiment.

The second flexible linear element is constructed of a material similar to or identical to the material used to construct the first linear element 42. The second linear element has a diameter equal to the diameter of the first linear element 42. The second linear element can have a length identical to or different from the length of the first linear element 42.

The first flexible linear element 42 has a first end 46 and a second end 48. The second linear element 44 has first end 50 and a second end 52. As seen in FIG. 3, the first linear element second end 48 abuts the second linear element first end 50 near the center of the envelope 30. The first linear cavity 32 has a first end 54 and a second end 56. Because the envelope 30 is constructed from elastic (stretchy) material, the first linear cavity first end 54 is held against the first linear element first end 46 and the first linear cavity second end 56 is held against the second linear element second end 52. The first linear cavity 32 is pulled into snug engagement with the first linear element 42 and the second linear element 44 by the contracting action of the envelope 30 material forming an attractive neat envelope. This stretchiness and contraction is shown schematically in FIG. 3 by a exaggerated puckered portion 58.

The flexible linear elements 42 and 44 are removable and reinsertable within the first linear cavity 32. As seen in FIGS. 2 and 3, the envelope 30 is discontinuous near the longitudinal center of the first linear cavity 32 and the second linear cavity 34. With reference to the figures, the first linear cavity 32 has a left half 62 extending from the first linear cavity first end 54 to a cut or slit 64 near the center of the first linear cavity 32. The cut or slit 64 extends around most of the circumference of the first linear cavity 32. The first linear cavity also has a right half 66. The first linear cavity right half extends from the first linear cavity second end 56 to a flap 68 which extends past the cut or slit 64. One can hold the flap 68 back upon the first linear cavity right half exposing the cut or slit 64. This allows one to grasp one of the linear elements 42, 44 and remove it from the first linear cavity 32. The remaining linear element can also be removed through the cut or slit 64. This allows a user to trim one or both of the flexible linear elements 42, 44 so that the total length of the two linear elements 42, 44 is equal to slightly greater than or slight less than the width of the door to which the draft blocker 10 is to be applied. Once the linear elements 42, 44 are appropriately trimmed, they can be reinserted through the cut or slit 64 into the first linear cavity 32.

The second linear cavity 34 is identical in all respects or the mirror image in all respects of the first linear cavity 32 and accommodates linear elements in an identical fashion.

As can be seen best in FIG. 2, a left strap 72 connects the first linear cavity first end 54 to the second linear cavity first end 74. The strap is attached to the ends of the linear cavities by sewing adhesive or the like. Similarly, a right strap 76 connects the first linear cavity second end 56 to the second linear cavity second end 78. The strap may be elastic.

Figure 4:
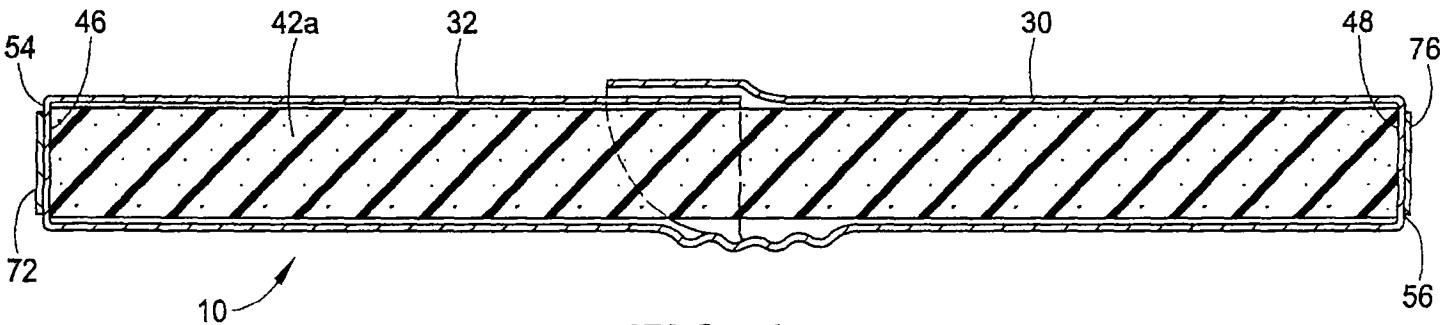
FIG. 4 is a cross section similar to FIG. 3 of a second embodiment of the disclosure.

FIG. 4 shows an embodiment similar to that seen in FIG. 3 except only a single linear element 42*a* is used in the first linear cavity 32. This linear element 42*a* extends for the full length of the first linear cavity 32. The flexible linear element 42*a* is sufficiently flexible so that it may be removed from the first linear cavity 32 by grasping it near its center, folding the linear cavity in half at the slit 64 and pulling the now substantially U-shaped linear element 42*a* out of the slit. The linear element 42*a* can be trimmed to appropriate length and reinserted into the first linear cavity 32 for placement under a door.

Placement of the draft blocker 10 under a door is illustrated in FIG. 1*a*. After the linear elements have been trimmed to an appropriate length, the door 20 is at least partially opened so that access to the free edge 24 of the bottom of the door 20 is available. One end of the draft blocker 10 is placed at the free edge end of the bottom of the door 20 and the draft blocker 10 is pushed toward the hinge edge 22 of the bottom of the door 20. Because the envelope 30 is flexible and stretchy, the envelope 30 and the left strap 72 will deform with the left strap laying down adjacent the web 36. The draft blocker 10 can be slid under the door 12. When the draft blocker 10 is slide fully under the door 12, the left strap 72 will be adjacent the hinge edge 22 of the door 12. The left strap 72 may free itself from under the door 20 or may require some urging by a user. Once the left strap 72 is freed, it becomes upright and engages the hinge edge 22 of the door 12. The right strap 76 engages the free edge 24 of the door 12. The first linear cavity 32 engages one side of the door 12 and the second linear cavity 34 engages the opposite side of the door 12. Because the envelope 30 is elastic and stretchy, and because, in most circumstances, the web 36 is less wide than the thickness of the door 12, the draft blocker 10 fits snugly against both faces of the door and both edges of the door providing a neat, tight fit and draft blocking action. The elasticity of the web 36 will also urge the two linear cavities 32, 34 toward one another causing the linear cavities 32, 34 to rotate downwardly and engage the floor 16 under the door. This engagement will be gentle rather than forceful. This provides sufficient engagement to stop or minimize drafts while allowing light engagement minimizing wear on the envelope 30 and draft blocker 10 in general.

The elastic nature of the envelope 30 also allows the envelope to automatically adjust to different width doors. The user can cut the linear elements to a desired size and insert them into the linear cavities 32, 34. The envelope 30 stretches to accommodate the desired size. The envelope 30 may be partially coated with material such as plastic to improve durability. A plastic coating may be provided in the form of coated dots or islands 38 on the bottom of the envelope 30 only as seen in FIG. 3. The draft blocker 10 can also be used under a window.

Figure 5:
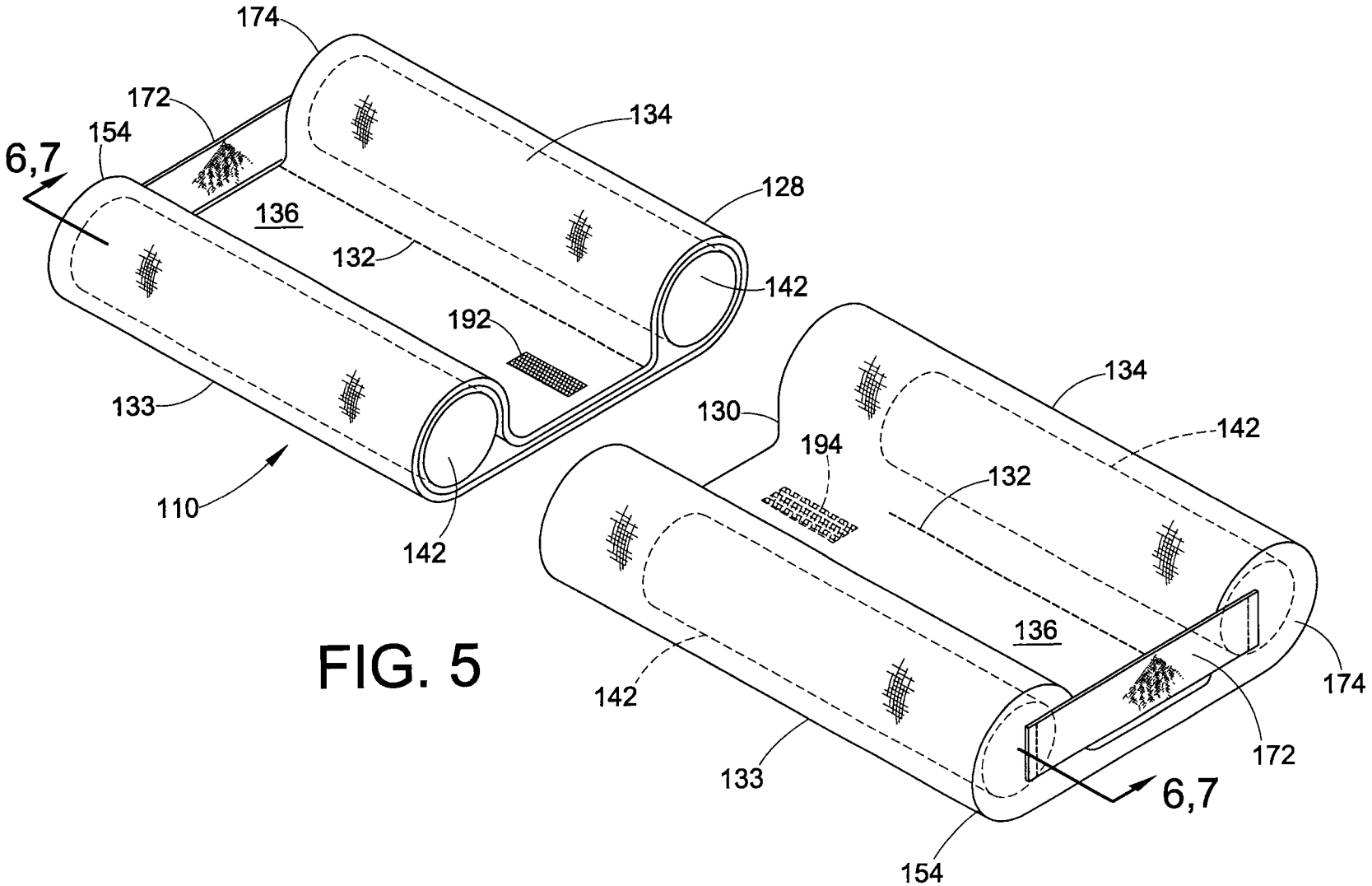
FIG. 5 is a perspective view of yet another embodiment of the disclosure.

Another embodiment of the disclosure is illustrated in FIG. 5.

The envelope 30 can be fabricated from one or more pieces of sheet material. As previously described, the preferred material is an elastic fabric material stitched or glued together to form the first linear cavity 32, the second linear cavity 34 and the web 36. Additional pieces of sheet material, preferably elastic fabric material are used to create the left strap 72 and the right strap 76 which are stitched or glued to the envelope 30. One method for creating the first and second linear cavities, 32, 34 and web 36 in the envelope 30, is sewing.

Figure 11A:
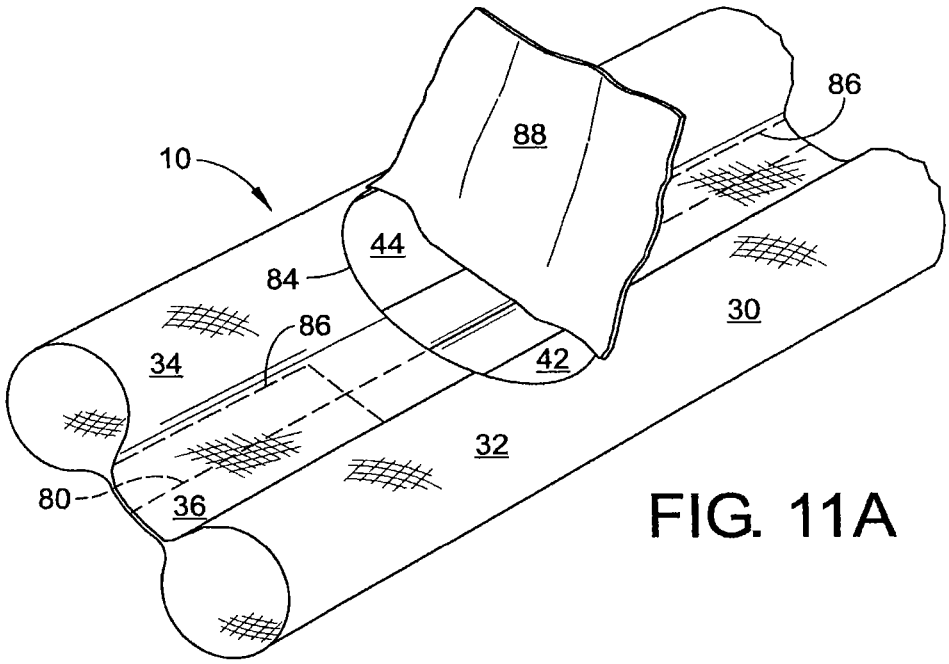
FIG. 11A is a detail view of the embodiment of FIGS. 1A, 1B, 2 and 3 with a modified central portion of the envelope with a flap in the open configuration; and, FIG. 11B is a view similar to that seen in FIG. 11A with the flap shown in the closed position.
Figure 11B:
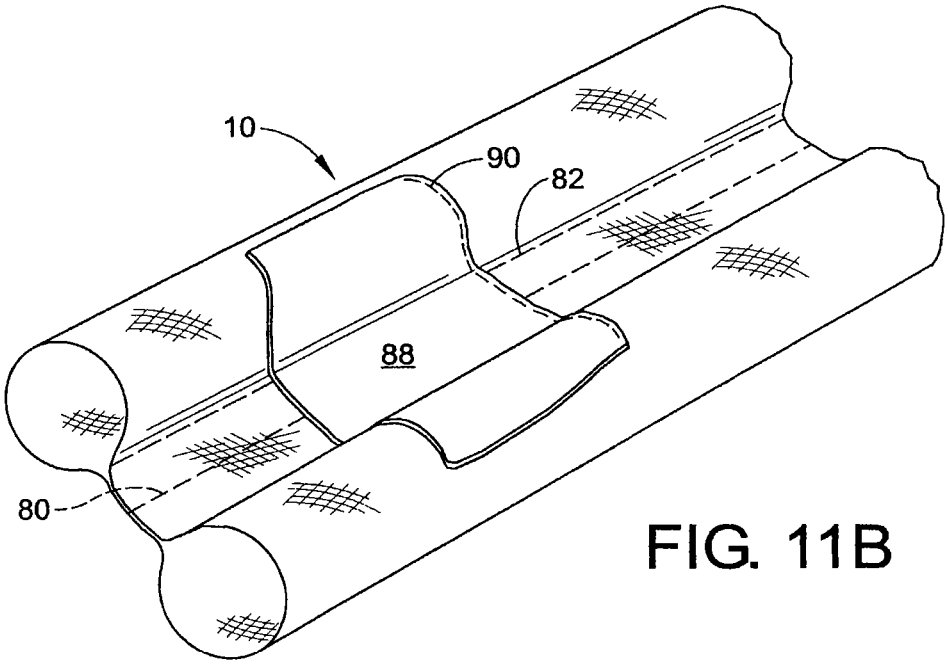

A variation on the embodiment shown in FIGS. 1-4 is seen in FIGS. 11A and 11B. The draft blocker 10 of FIGS. 11A and 11B is identical in all respects to the draft blocker 10 seen in FIGS. 1-4 with the exception of the structure allowing the insertion and extraction of flexible linear elements. As seen in FIG. 11A, the cut or slit 84 allowing insertion of the linear elements extends from the first linear cavity 32 across the web 36 and into the second linear cavity 34. The cut or slit 84 does not need to extend as far outwardly on the linear cavities 32, 34 as the opening into the web portion allows for entry of the linear elements 42, 44 partially through the web. This improves the esthetics of the device. When the draft blocker 10 is installed upon a door, the portions of the linear cavities 32, 34 adjacent the web 36 are held against the door 12. They are hidden from view. The portions of the linear cavities 32, 34 remote from the web 36 face outwardly and are visible when the product is in use.

In order to allow easy access to the linear cavities 32, 34 through the slit 84, two rectangular stitch patterns 86 are used to define the web 36. As seen in FIG. 11A, this allows the portion of the envelope 30 adjacent the slit 84 to lift freely. The top layer can be separated from the bottom layer giving access to the linear cavities, 32, 34. A flap 88 is fixed as by stitching 90 to the envelope 30 on one edge of the cut or slit 84. The flap 88 is shown in exaggerated size in the figures for purposes of clarity. The flap 88 is provided to close the slit 84 when the draft blocker 10 is in use. The flap 88 is optional as it is not necessary to the functioning or esthetics of the draft blocker 10. The slit may remain uncovered. The slit 84 may be selectively closed by a closure element fixed to the envelope over more of its periphery. Such a closure element would not flap. Rather, it would lie against the envelope as a second layer, but allow insertion and removal of the linear elements. In the embodiment seen in FIGS. 11A and 11B, the envelope 30 is first formed into one large tubular shape by sewing two edges of a generally rectangular piece of fabric together at a first seam 80. Two rectangular stitch pattern 86 (only partially shown) are added joining two layers of the fabric forming the envelope 30 together thus forming the web 36. The rectangular stitch pattern 86 do not extend all the way to the ends of the envelope 30. Rather, portions of the envelope 30 adjacent the linear cavity ends 54, 56, 74, 78 are left free. This allows for easier sewing. This is permissible as it is not required that the two remaining cavities, 32, 34 be completely isolated from one another. The ends of the envelopes are sewn forming the cavity ends and the straps 72, 76 attached.

Figure 6:
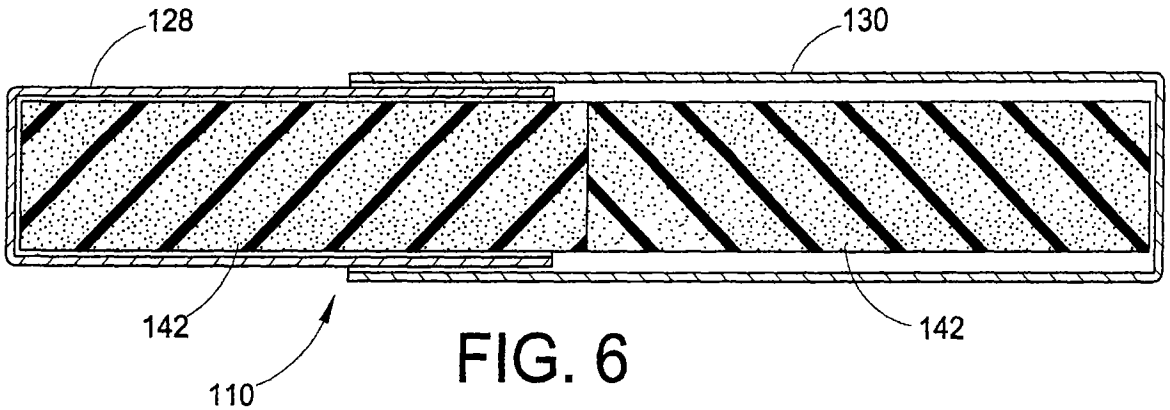
FIG. 6 is a cross section of one of the tubular portions of the embodiment of FIG. 5 in the fully assembled configuration.

Another embodiment of the disclosure is seen in FIGS. 5 and 6. Draft blocker 110 has a first envelope element 128 and a second envelope element 130. The first envelope element 128 and the second envelope element 130 are both constructed from sheet material, preferably fabric material. In this embodiment, the envelope elements, 128, 130 do not need to be elastic but can be relatively inelastic fabric or sheet material. Preferably the envelope elements 128, 130 are flexible but not necessarily elastic. The first envelope element 128 is fabricated from a rectangular piece of sheet material by bringing two edges of the sheet material together and sewing fixed to one another. This creates a large tube. The tube is laid flat as a two layer rectangle and stitched near its center along its length with two longitudinal stitch lines, only one of which is visible in the figures, 132. The stitch lines 132 do not need to extend all the way to the closed end of the first envelope element 128.

One end of the tube created is sewn shut forming a closed end.

As can be seen in FIG. 5, the stitch lines 132 create a first linear cavity 133, a second linear cavity 134, and a web 136 in the first envelope element 128. Flexible linear elements 142 are contained in the first linear cavity 133 and the second linear cavity 134. The flexible linear elements 142 are preferably flexible foam plastic cylinders. The flexible linear elements 142 contained in the first envelope element 128 are shown as having a length substantially identical to the length of the linear cavities 133, 134 in the first envelope element 128. This is not necessary. The flexible linear elements can have different lengths.

A strap 172 preferably made from elastic sheet material interconnects the closed ends 154,174 of the first linear cavity 133 and the second linear cavity 134.

The second envelope element 130 is very similar in structure to the first envelope element 128. The second envelope element 130 has a first linear cavity 133, a second linear cavity 134, and a web 136. The first linear cavity 133 has a closed end 154. The second linear cavity has enclosed end 174. A strap 172 interconnects the closed ends 154,174 of the two linear cavities. The ends of the linear cavities 133, 134 opposite the closed ends are open.

With respect to the elements of the second envelope element 130 thus far described, the second envelope element 130 and the first envelope element 128 are identical.

Longitudinal stitch lines 132 separate the first linear cavity 133, the second linear cavity 134 and the web 136 from one another. A difference between the second envelope element 130 and the first envelope element 128 is the length of the longitudinal stitch lines 132. On the second linear envelope element 130, the longitudinal stitch lines 132 do not extend all the way to the open end of the linear cavities 133, 134. Rather, a portion of the second envelope element 130 adjacent the open ends of the linear cavities 133, 134 is left free.

A first half 192 of a hook and loop fastener is positioned adjacent the end of the web 136 remote from the strap 172 on the first envelope element 128. A second half of a hook and loop fastener is positioned on the inside of the upper layer of the web 136 of the second envelope element 130.

Flexible linear elements 142 are positioned in the first linear cavity 133 and second linear cavity 134 of the second envelope 130.

The first envelope element 128 is joined to the second envelope element 130 in a telescoping manner as seen in FIG. 6. That is, the open end of the first envelope element 128 is slid into the open end of the second envelope element 130. Because the stitch line 132 in the second envelope element 130 does not go all the way to the end of the second envelope element 130, the second envelope element web portion 136 can separate into two layers with the first envelope element 128 penetrating therebetween. When the two envelope elements 128,130 are assembled to the length desired by the user, the second half 194 of the hook and loop fastener is pressed against the first half 192 of the hook and loop fastener fixing the two envelope halves together. As can be seen in FIG. 6, the linear elements 142 abut one another and abut the closed ends of the combined linear cavities. A complete draft blocker is thereby assembled. Of course, the user can trim the flexible linear elements to achieve a length for the draft blocker 110 appropriate for the door upon which it is to be used. The door stop 110 is installed in a manner identical to the draft blocker 10 described with respect to FIG. 1-4. Moreover, the draft blocker 110 can be removed and reused on a different door. The draft blocker 110 can be removed, the linear elements removed from the envelopes and trimmed to accommodate a different size door. The draft blocker 110 can be removed from the door, the linear elements removed from the envelopes 130, 128 and the envelope elements in a washing machine should they become soiled.

Figure 7:
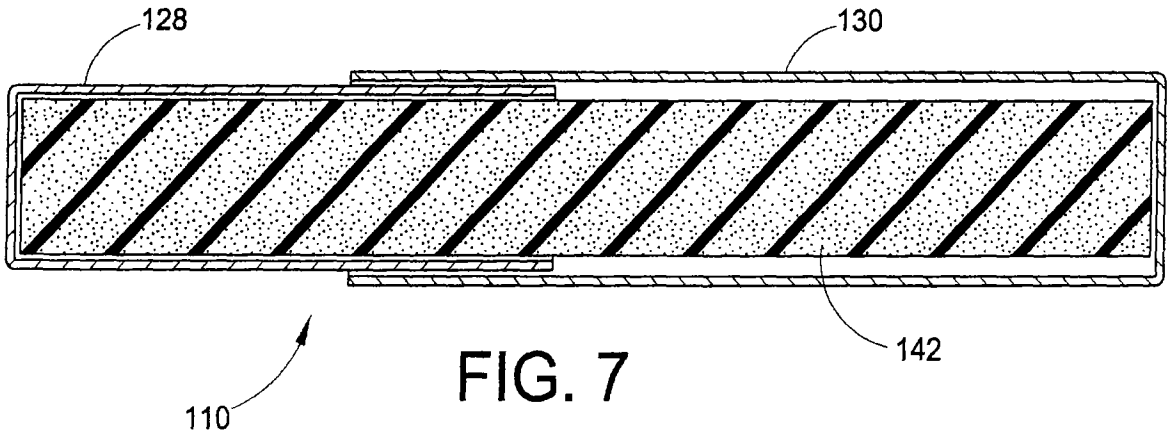
FIG. 7 is a cross section of another embodiment of the disclosure similar to FIG. 6.

FIG. 7 illustrates a variation of the embodiment seen in FIGS. 5 and 6. The draft blocker 110 seen in FIG. 7 is identical in all respects with the draft blocker 110 seen in FIGS. 5 and 6 except for the linear element 142. In the variation seen in FIG. 7, only one linear element 142 is used in each of the linear cavities 133, 134.

Figure 8:
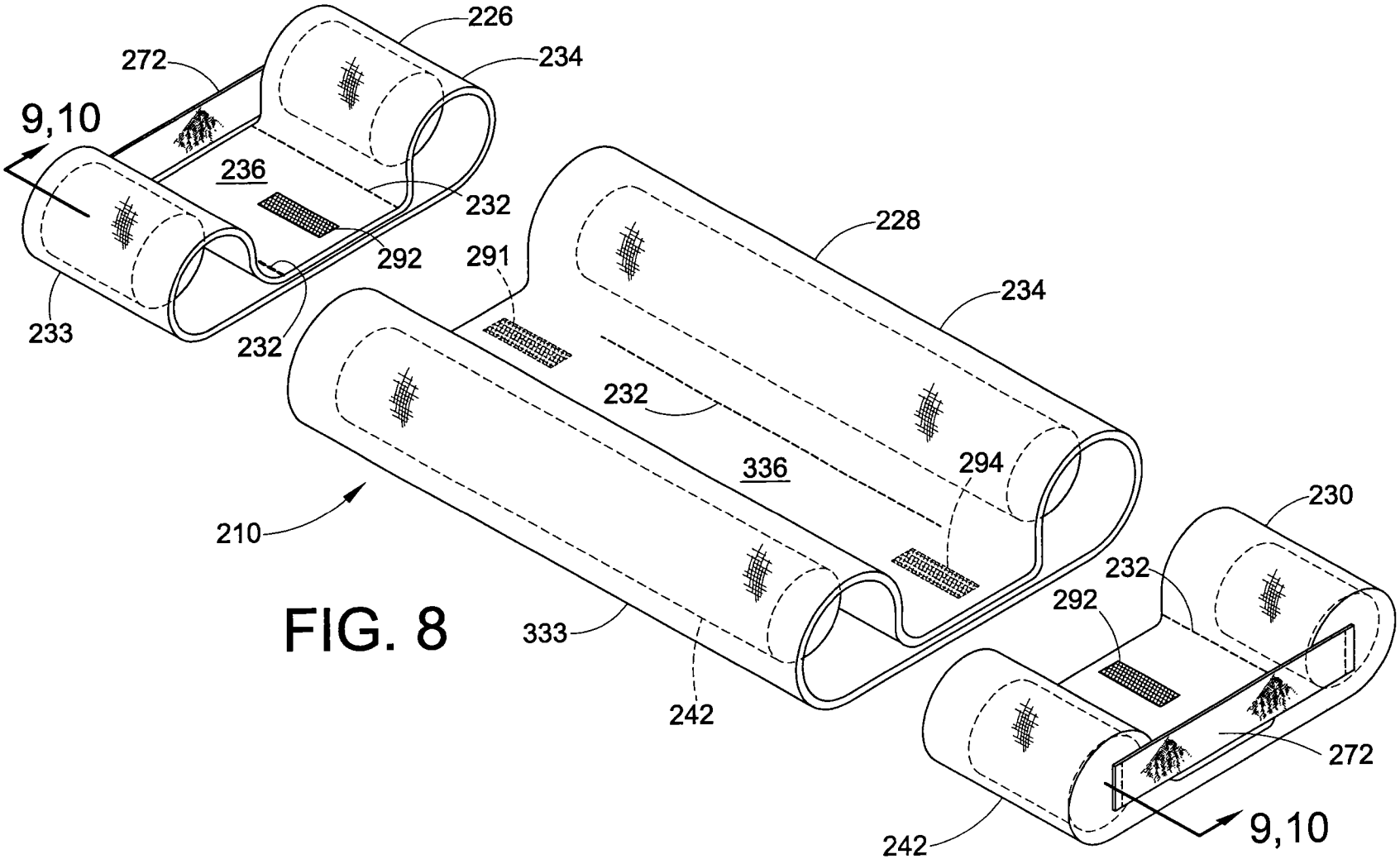
FIG. 8 is a perspective view similar to FIG. 5 of still another embodiment of the disclosure.
Figure 9:
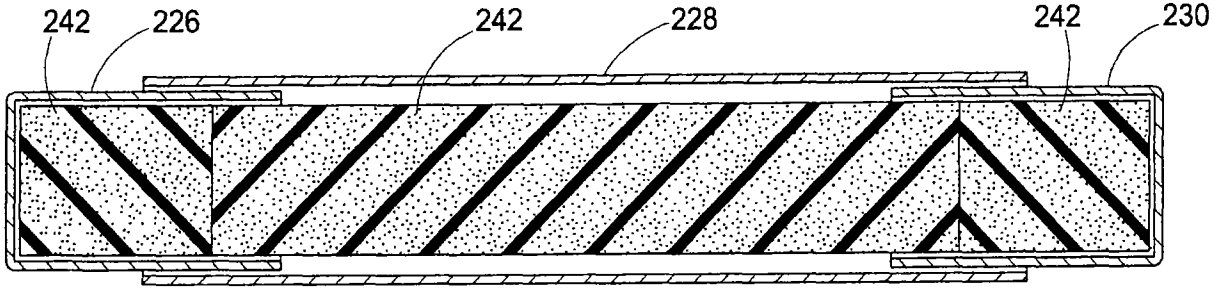
FIG. 9 is a cross section of one of the tubular portions of the embodiments seen in FIG. 8 in the fully assembled configuration.

Another embodiment of the disclosure is seen in FIGS. 8 and 9. A draft blocker 210 comprises several flexible linear elements 242 and three envelope elements: a first envelope element 226, a second envelope element 228 and a third envelope element 230. The first envelope element 226 and the third envelope element 230 are substantially identical to the first envelope element 128 described with respect to FIG. 5 and FIG. 6. That is, the first and third envelope elements 226, 230 are constructed from flexible sheet material to have a first linear cavity 233, a second linear cavity 234, and a web 236 interconnecting the two linear cavities. The linear cavities have closed ends interconnected by a strap 272. The linear cavities 233, 234 have opened ends opposite the closed ends. Longitudinal stitching 232 on either side of the web 236 hold the two layers of the 236 together adjacent the open end of the cavities 233, 234. One half 292 of a hook and loop fastener is provided on the outer upper surface of the web 236 adjacent the open end of the cavity on each of the first envelope element 226 and the third envelope element 230.

The second envelope element 228 is also fabricated from flexible sheet material, preferably a fabric. Two lines of longitudinal stitching 232 (only one of which is visible in the figure) separate the second envelope element into a first linear cavity 333, a second linear cavity 334 and a web 336. The first linear cavity 333 has two open ends. The second linear cavity 334 also has two open ends. The longitudinal stitching 232 does not extend all the way to the ends of the web 336. Rather, the two ends of the web 336 adjacent the open ends of the linear cavities are left unstitched so that the two layers of the web 336 can be separated one from the other. The second halves 294 of two hook and loop fasteners are fixed to the interior surface of the upper layer of the web 336, one fastener half adjacent each end of the web 336. In use, the end user will measure the door to which the draft blocker 210 is to be applied. He will trim the flexible linear elements 242 to have an appropriate total length for the door involved. The linear elements 242 are inserted into the various envelope elements, 226, 228, 230. The three envelope elements are then telescoped together with the second halves 294 of the hook and loop fasteners overlaying the first halves 292 of the hook and loop fasteners on the first and third envelope elements. When fully assembled, the various flexible linear elements 240 abut one another as seen in FIG. 9. The ends of the second envelope element 228 overlay the ends of the first envelope element 226 and third envelope element 230 creating a fully assembled draft blocker 210 which is pleasing in appearance and appropriately sized for the door in question.

Figure 10:
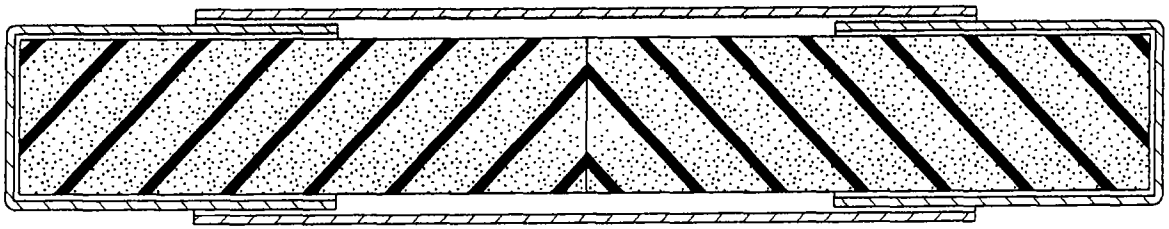
FIG. 10 is a cross section similar to FIG. 9 of a variation of the embodiment of FIG. 9.

It is not necessary that six linear elements be used in the embodiment of FIGS. 8 and 9. Four linear elements, as illustrated in FIG. 10 can be used instead. Two linear elements, one for each assembled linear cavity can be used. Linear elements other than cylindrical foam plastic can be used. Square foam plastic elements can be used, hexagonal foam plastic elements can be used.

The three envelope elements 226, 228, 230 can be separated from one another and washed in a washing machine if they become soiled. After washing, the linear elements 242 are reinserted, the envelope elements joined as described above, and the draft blocker 210 reinstalled under the door of choice.

In the embodiments using hook and loop fasteners, the lengths of the hook and loop fastener elements are sufficient to provide significant length adjustment for the assembled draft blocker.

All of the embodiments described above provide a draft blocker which is easily sized to match a door of choice, easily installed and uninstalled by the end user, easily washed upon soiling, free of loose flaps and unnecessary layers and attractive and easy to use.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A draft blocker adapted for use under a door or window having a width comprising:

a first flexible linear element having a first length with a first end and an opposite second end;

a second flexible linear element having a second length with a first end and an opposite second end;

an envelope housing;

a first linear cavity having a first closed end and a second closed end, said first linear cavity receives the first flexible linear element;

a second linear cavity having a first closed end and a second closed end, said second linear cavity receives the second flexible linear element;

a web interconnecting the first linear cavity and the second linear cavity in generally spaced parallel relationship;

at least one envelope opening to allow passage of the flexible linear elements into the envelope communicating with the first linear cavity and the second linear cavity, the envelope opening being positioned along the envelope housing and spaced from the cavity closed ends such that when at least one linear cavity receives the flexible linear element, the first closed end of at least one of the linear cavities is to be held against the first end of the flexible linear element and the second closed end of that same linear cavity is held against the second end of the flexible linear element such that the linear cavity is pulled into snug engagement with the linear element.

2. The draft blocker of claim 1 wherein the envelope is constructed of flexible sheet material joined to form the linear cavities and the web.

3. The draft blocker of claim 2 wherein said first linear cavity first closed end is connected to said second linear cavity first closed end by a flexible strap and said first linear cavity second closed end is connected to said second linear cavity second closed end by a flexible strap.

4. The draft blocker of claim 2 wherein at least a portion of said envelope is elastic.

5. The draft blocker of claim 2 wherein the envelope opening is at least one slit in the envelope allowing access to the first linear cavity and the second linear cavity.

6. The draft blocker of claim 5 wherein said slit extends across a portion of the first linear cavity, the web and a portion of the second linear cavity.

7. The draft blocker of claim 6 wherein said envelope has at least one flexible element selectively closing the at least one slit.

8. The draft blocker of claim 6 wherein said flexible linear elements are flexible foam cylinders.

9. The draft blocker of claim 2 wherein said flexible sheet material is a fabric joined by sewing.

10. The draft blocker of claim 2 wherein said flexible sheet material is a coated fabric.

11. The draft blocker of claim 1 wherein the envelope opening is approximately positioned near a longitudinal center of the first linear cavity and the second linear cavity.

12. A draft blocker adapted for use under a door or window having a width comprising:

a first flexible linear element having a first length;

a second flexible linear element having a second length;

an envelope housing;

a first linear cavity having a first closed end and a second closed end, said first linear cavity receives the first flexible linear element;

a second linear cavity having a first closed end and a second closed end, said second linear cavity receives the second flexible linear element;

a web interconnecting the first linear cavity and the second linear cavity in generally spaced parallel relationship;

a third linear flexible element adapted to be received in said first linear cavity longitudinally adjacent the first linear flexible element;

a fourth linear flexible element adapted to be received in said second linear cavity longitudinally adjacent the second linear flexible element at least one envelope opening to allow passage of the flexible linear elements into the envelope communicating with the first linear cavity and the second linear cavity, the envelope opening being positioned along the envelope housing and spaced from the cavity closed ends such that when at least one linear cavity receives the flexible linear elements, the first closed end of at least one of the linear cavities is held against a first end of one of the flexible linear elements and the second closed end of that same linear cavity is held against an opposite end of the other flexible linear element such that the linear cavity is pulled into snug engagement with the linear elements.

13. A draft blocker adapted for use under a window or a door, said window or door having a width comprising:

a first flexible linear element having a first length;

a second flexible linear element having a second length;

a first flexible envelope element having a first linear cavity having a closed end and an open end, said first linear cavity adapted to receive the first flexible linear element;

a second linear cavity having a closed and an open end, said second linear cavity adapted to receive the second flexible linear element;

a web interconnecting the first linear cavity and the second linear cavity in generally spaced parallel relationship;

a second flexible envelope element having a first linear cavity having an open end and being adapted to receive the first flexible linear element;

a second linear cavity having an open end and being adapted to receive the second flexible linear element;

a web interconnecting the first linear cavity and the second linear cavity;

said second envelope element adapted to surround a portion of said first envelope element with a portion of said second envelope element first linear cavity surrounding a portion of said first envelope element first linear cavity adjacent its open end;

a portion of said second envelope element second linear cavity surrounding a portion of said first envelope element second linear cavity adjacent its open end;

whereby said first flexible linear element may be at least partially contained within said first envelope element first linear cavity and said second envelope element first linear cavity and said second flexible linear element may be at least partially contained within said first envelope element second linear cavity and said second envelope element second linear cavity, and, a fastener releasably holding said first envelope element in engagement with said second envelope element.

14. The draft blocker of claim 13 wherein said second envelope element first linear cavity has a closed end and said second envelope element second linear cavity has a closed end.

15. The draft blocker of claim 14 wherein the closed end of the first envelope element first linear cavity is connected to the closed end of the second linear cavity of the first envelope element by a flexible strap and the closed end of the first linear cavity of the second envelope element is connected to the closed end of the second linear cavity of the second envelope element by a flexible strap.

16. The draft blocker of claim 13 wherein said second envelope element first linear cavity has a second open end, said second envelope element second linear cavity has a second open end, said draft blocker further comprises a third flexible envelope element substantially identical to said first envelope element and said second envelope element interconnects to said third envelope element in a manner essentially to the interconnection to the first envelope element whereby said first flexible linear element and said second flexible linear element are contained within said first envelope element, said second envelope element, and said third envelope element.

17. A draft blocker adapted for use under a window or a door, said window or door having a width comprising:

a first flexible linear element having a first end, a second end and first length;

a second flexible linear element having a first end, a second end and a second length substantially equal to the first length;

a web connecting the first flexible linear element to the second flexible linear element such that the first linear element and the second linear element are held spaced apart, substantially parallel to one another with the first end of the first linear element adjacent to the first end of the second linear element and the second end of the first linear element adjacent to the second end of the second linear element;

a first flexible strap extending from the first end of the first linear element to the first end of the second linear element, the flexible strap being substantially perpendicular to the web; and a second flexible strap extending from the second end of the first linear element to the second end of the second linear element, the second flexible strap being substantially perpendicular to the web.

18. The draft blocker of claim 17 being adapted to be positioned under a door having a bottom, a first side, a second side, a hinge edge and a free edge with the first linear element adjacent the door first side, the second linear element adjacent the door second side, the web adjacent the door bottom, the first strap adjacent the door hinge end and the second strap adjacent the free end whereby the draft blocker is held in engagement with the door when the door is moved.

19. The draft blocker of claim 17 where the first linear element is cylindrical and the second linear element is cylindrical.

* * * * *